US005405091A

United States Patent [19]

Folsberg

[11] Patent Number: 5,405,091

[45] Date of Patent: Apr. 11, 1995

[54] METHOD FOR GRINDING OF MATERIAL

[75] Inventor: Jan Folsberg, Copenhagen, Denmark

[73] Assignee: F. L. Smidth & Co., A/S, Denmark

[21] Appl. No.: 101,872

[22] Filed: Aug. 4, 1993

[30] Foreign Application Priority Data

Aug. 17, 1992 [DK] Denmark ..... 1017/92

[51] Int. Cl.[6] ..... B02C 23/12

[52] U.S. Cl. ..... 241/24; 241/29; 241/80

[58] Field of Search ..... 241/24, 29, 80, 81, 241/224, 227

[56] References Cited

U.S. PATENT DOCUMENTS

| | | | |
|---|---|---|---|
| 1,562,617 | 11/1925 | Burch | 241/24 |
| 2,381,351 | 8/1945 | Hardinge | 241/24 X |
| 3,601,321 | 8/1971 | Barth | 241/24 X |
| 4,728,044 | 3/1988 | Duill et al. | 241/24 X |
| 4,840,314 | 6/1989 | Kulander | 241/24 |
| 4,840,315 | 6/1989 | Rubin et al. | 241/24 |
| 4,976,469 | 12/1990 | Paliard et al. | 241/24 |

*Primary Examiner*—Douglas O. Watts
*Attorney, Agent, or Firm*—Daniel De Joseph

[57] ABSTRACT

To improve the operation of a roller press, a method is described according to which fluidized material that is discharged from the roller press over and above the sides of the roller press is collected and passed on to the next process stage together with the material which is ground in the roller press and discharged from the centermost section of the roller press. The remaining material which was ground in the roller press and discharged from the roller press through its end sections is returned to the roller press.

By practicing the method of the present invention, a depletion of the material in the feed shaft is prevented due to a more stable roller feed, hence obtaining a smooth operation, even for high circulation factors, a higher average power absorption and a higher output level.

4 Claims, 1 Drawing Sheet

METHOD FOR GRINDING OF MATERIAL

The invention relates to an improvement to a known method for grinding material, for example material used in the manufacture of cement, in a roller press installation, by which known method the portion of the material which is pressed in the roller press and leaves the roller press from its centermost section is passed on to a next process stage, for example, to a tube mill.

Figure 1:
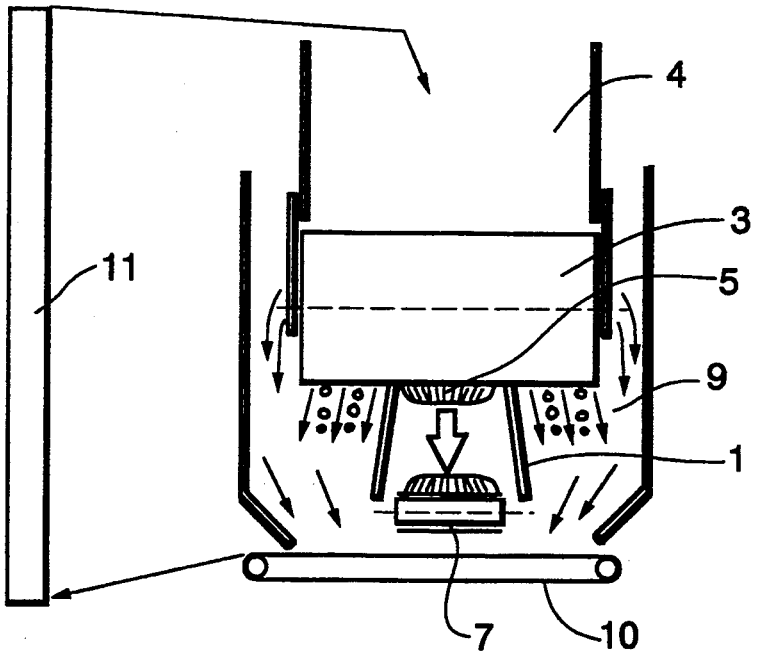

FIG. 1 shows, in a side view, a prior art roller press installation which may be used for carrying out the aforementioned known method, comprising a feed shaft 4, a splitting gate 1 which is located under the roller press 3 for splitting the pressed material into a first fraction 5 containing the material which was pressed in the roller press and exited said press from the centermost section of the roller press which first fraction is passed on to a next process stage via a belt conveyor 7, and a second fraction 9 containing the remaining material which was pressed in the roller press and exited said press from the end sections of the roller press, which second fraction is returned to the roller press via a belt conveyor 10 and an elevator 11 for additional grinding.

By utilizing a roller press with a constant roller speed and shaft feeding, the roller capacity is substantially constant. When finer products are manufactured, the fresh feed to the roller press is reduced, and consequently the amount of material being recirculated to the roller press must necessarily be increased in order that shaft feeding can be sustained, but due to the simultaneous increase in the fineness of the recirculated material when manufacturing such finer products, this may have the undesirable effect of causing a fluidization of some of the material located above the roller press to occur, which may cause the material in the shaft above the roller press to be depleted in a matter of seconds since fluidized material behaves in the same way as a liquid. Such fluidized material will flow out over the sides of the roller press and behind the rollers. Therefore, such fluidized material will not pass through the roller press for discharge. The power absorption of the roller press will be significantly reduced immediately after the material is depleted and until the feed shaft is again charged with material.

However, it can be ascertained that for a time prior to such a depletion of material from the shaft, the amount of fluidized material that never passes through the roller press for discharge but instead is discharged over and above the sides of the roller press will be gradually increased. Since this fluidized material consists of relatively fine particles it would be undesirable to recycle the fluidized material to the roller press along with the second fraction of pressed material described above. In the prior art process described above, the gradually increased amount of fluidized material which is returned results in an accumulation of this material in the shaft proper, which may result in a depletion of material in the shaft above the roller.

It is the object of the present invention to provide a method by which the aforementioned disadvantages are remedied.

This is obtained by a method wherein the fluidized material that does not pass through the roller press immediately prior to discharge but rather is discharged from the roller press over and above the ends of the roller press or over and behind the rollers is collected after such discharge and is passed on to the next process stage together with the just pressed material from the centermost section of the roller press. The remaining pressed material which was discharged through the end sections of the roller press is returned to the roller press.

Since, as previously noted, the capacity of the roller press is constant, and the fluidized material is collected and passed on to a next process stage, it will be necessary to return some of the material exiting from the centermost section of the roller press which has hitherto been passed on to the next process stage. Therefore, in a preferred embodiment of the present invention the dimensions of the splitting gate used to split the pressed material into a first fraction and a second fraction will be adjustable. Since the material exiting the roller press from its centermost section consists primarily of hard and stable agglomerates, such material is more suitable for being returned to the shaft then fine fluidized material.

By carrying out the method according to the invention it will therefore be possible to prevent a depletion of the material in the feed shaft due to a more stable roller feed, hence obtaining a smooth operation, even for high circulation factors, a higher average power absorption and a higher output level.

Additional features of the method according to the invention are set forth below.

Figure 2:
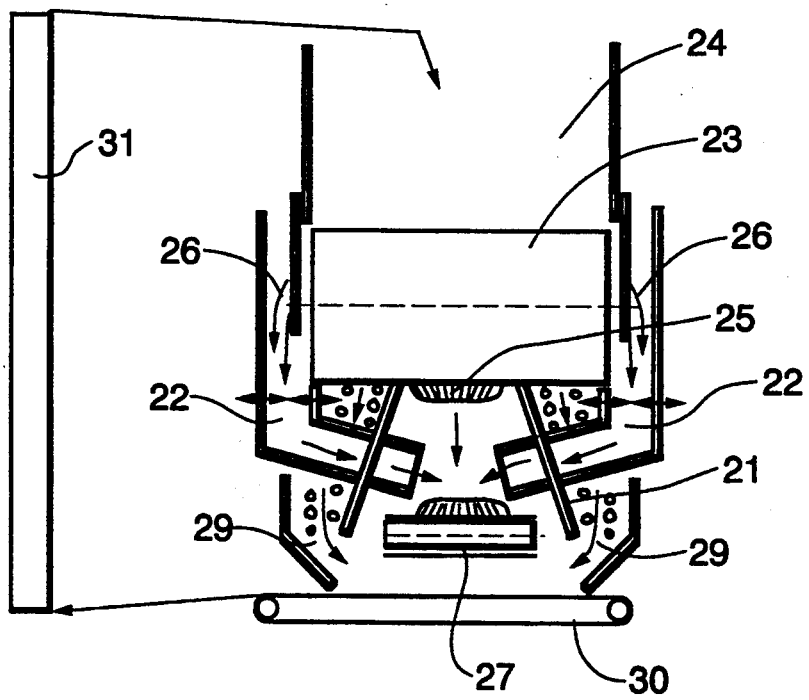

The invention will now be described in further details with reference to the accompanying drawings, being diagrammatical, wherein FIG. 1 shows a known roller press installation, and FIG. 2 shows, also in a side view, a roller press installation for carrying out the method according to the invention.

FIG. 1 has been explained in the foregoing text.

The roller press installation shown in FIG. 2 comprises a feed shaft 24, a splitting gate 21, a roller press 23, a collecting chamber 22 for fluidized material 26, belt conveyors 27 and 30, and an elevator 31.

A difference between the installation of FIG. 1 and the installation of FIG. 2 is that the latter includes a collecting chamber 22 which carries the fine fluidized material 26, which material did not pass through the roller press for discharge, to the belt conveyor 27 for conveyance to the next process stage.

The walls of the splitting gate 21 as well as the walls of the collecting chamber 22 which face the roller may be adjusted in the horizontal direction as indicated by the arrows so that the material loads of the different material streams may be regulated.

During operation the material is carried from the feed shaft 24 down into the roller press 23 in which the grinding takes place. The centermost,i.e. first, fraction 25 of the ground material is discharged onto the first belt conveyor 27 which passes it on to a next process stage in, for example, a tube mill, whereas the remaining, i.e. second, fraction of ground material 29 is discharged onto the second belt conveyor 30 which carries this material to the elevator 31 for returning to the shaft 24. The returned material 29 contains a certain amount of material which is so fine that it should preferably be passed on to the next process stage. By the method according to the invention this material is separated gradually as it accumulates and forms a fluidized layer above the roller gap, this being done by collecting the material in the collecting chamber 22 when it flows out over the end edges of the rollers. From the collecting chamber 22 the material is passed to the first belt conveyor 27 for conveyance to the next process stage together with the centermost material fraction 25.

Variations on the design or operation of the above illustrative embodiments may be readily made to adapt the inventive process to various operational demands, all of which are within the scope and spirit of the present invention. Consequently, it is to be understood that various modifications and substitutions, as well as rearrangements and combinations of apparatus, and/or process steps, can be made by those skilled in the art without departing from the spirit and scope of this invention.

I claim:

1. A method for processing material, such as material used in the manufacture of cement, in a roller press installation, which method comprises, separating, by means of a material splitting means, material after it is ground in the roller press into two fractions, a first fraction of ground material which, after being pressed in the roller press, leaves the roller press from its centermost section, which first fraction is passed on to a next process stage, and a second fraction of ground material which, after being pressed in the roller press, leaves the roller press from its end sections, which second fraction is returned to the roller press, and collecting fluidized material in a collecting means, said fluidized material being material which is discharged over and above the ends of the roller press or over and behind the roller press and not through the roller press, and passing said fluidized material on to the next process stage together with the first fraction of material.

2. A method according to claim 1 wherein the collecting means for the fluidized material is adjusted to cover a larger or smaller area.

3. A method according to claim 1, wherein the collecting means is adjusted to collect a portion of the material that is discharged from the end sections of the roller press.

4. A method according to claim 1, wherein is adjusted to vary the amount of material collected as the first fraction of material.

* * * * *